US005806378A

United States Patent [19]

Friedman

[11] Patent Number: 5,806,378

[45] Date of Patent: Sep. 15, 1998

[54] RELEASABLE SECURING KNOB ASSEMBLY

[75] Inventor: Melvin H. Friedman, Alexandria, Va.

[73] Assignee: The United States of America as represented by the Secretary of the Army, Washington, D.C.

[21] Appl. No.: 672,214

[22] Filed: Jun. 27, 1996

[51] Int. Cl.[6] ..... G05G 1/10

[52] U.S. Cl. ..... 74/553; 16/114 R

[58] Field of Search ..... 74/553, 526, 527; 16/121, 114 R; 292/349; 267/158, 163

[56] References Cited

U.S. PATENT DOCUMENTS

| | | | |
|---|---|---|---|
| 3,880,534 | 4/1975 | Schmidt | 16/121 |
| 3,994,608 | 11/1976 | Swiderski et al. | 74/553 X |
| 4,067,658 | 1/1978 | Ueno et al. | 74/553 X |
| 4,113,399 | 9/1978 | Hansen | 74/553 X |
| 4,466,377 | 8/1984 | Kolb et al. | 16/114 R |
| 5,329,827 | 7/1994 | Sell | 74/553 |
| 5,537,893 | 7/1996 | Snider | 74/553 |

*Primary Examiner*—Vinh T. Luong
*Attorney, Agent, or Firm*—Milton W. Lee; John E. Holford; Alain L. Bashore

[57] ABSTRACT

A releasable securing knob assembly including a biased leaf spring element which securely locks a knob onto a shaft, so that removal can only be effected by accessing and debiasing the leaf spring through a slot within the knob.

1 Claim, 3 Drawing Sheets

RELEASABLE SECURING KNOB ASSEMBLY

BACKGROUND OF THE INVENTION

1. Field of the Invention

The present invention generally relates to, more specifically, to a knob and shaft assembly that can be releasably secured without use of a set screw.

2. Description of Prior Art

The typical prior art knob uses either a spring or a set screw in the knob which presses against a flattened portion on what would otherwise be a circular shaft. This type of knob is not suitable for knobs which must be pulled to switch them to the proper position. The set screw pressing against the flat portion can loosen, allowing the knob to fall off the shaft. This is a problem especially for equipment used in the field where a knob can be easily lost, or no screw driver available for tightening a set screw.

While the prior art has reported using knobs none have established a basis for a specific knob design that is dedicated to the task of resolving the particular problem at hand. What is needed in this instance is a knob and shaft assembly that can be releasably secured to a shaft without the use of a set screw.

SUMMARY OF THE INVENTION

It is therefore one object of the invention to provide a knob and shaft assembly that can be releasably secured to a shaft without the use of a set screw.

According to the invention, there is disclosed a releasable securing knob assembly which includes a leaf spring element, knob, and shaft. The leaf spring element is an elongated structure with a straight and bent portion. Coupled to the bent portion, and projecting therefrom, is a wire and eyeloop. Within the knob is a central hole shaped in a semi-curricular pattern with flat section to loosely accommodate a shaft with similar cross-sectional shape. An access channel laterally bisects the knob to one side of the central hole to allow access to the eyeloop for releasing the knob from the shaft. The shaft includes an upwardly slanted cut to accommodate the bent portion of the leaf spring element. The leaf spring element is positioned within the central hole of the knob. The knob is then pressed onto the shaft until the bent portion of the leaf spring element snaps into the slanted notch, locking the knob onto the shaft. To remove the knob, the knob is pressed down on the shaft until the leaf spring element is straightened. The straightened spring metal moves the coupled wire and eyeloop into the hole within the knob, such that the eyeloop coincides within the channel and optional 14 drilled hole. The leaf spring element is then held in position by inserting a tool, such as a stiff wire, into the channel which engages through the eyeloop and thus stops the bent portion of the leaf spring element from bending back into the slanted notch as the knob is removed from the shaft.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
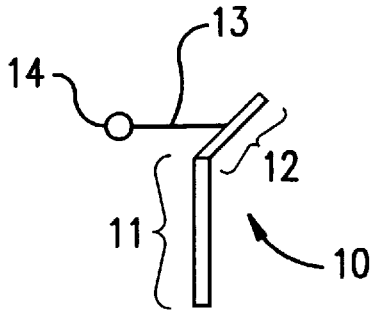
FIG. 1 is a side view of the leaf spring of the present invention.
Figure 2:
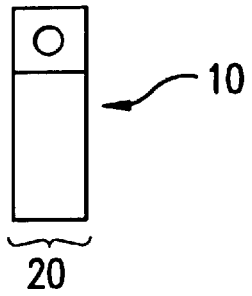
FIG. 2 is a front view of FIG. 1

Referring now to the drawings, and more particularly to FIGS. 1 and 2 there is shown side and top views of the leaf spring element utilized in the present invention. Leaf spring element 10, as shown in FIG. 1, is an elongated structure with straight portion 11 and bent portion 12. Coupled to bent portion 12, and projecting therefrom, is wire 13 to which is further coupled an eyeloop 14. As seen in FIG. 2 there is a predetermined width 20, determined by the size of the knob and shaft which is characteristic of the leaf spring element portions.

Figure 3:
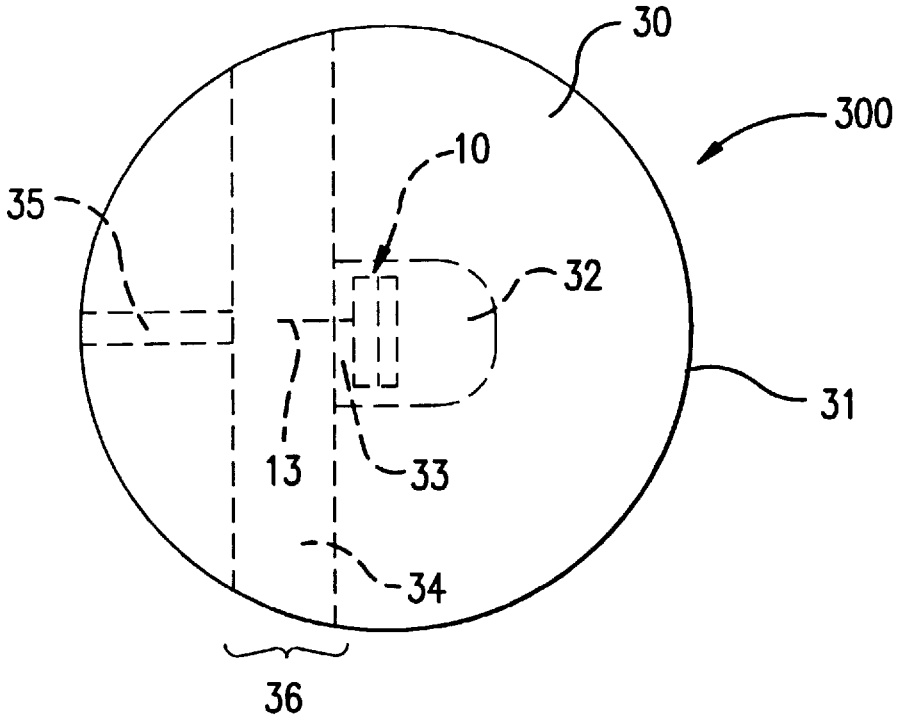
FIG. 3 is a top view of the knob of the present invention.
Figure 4:
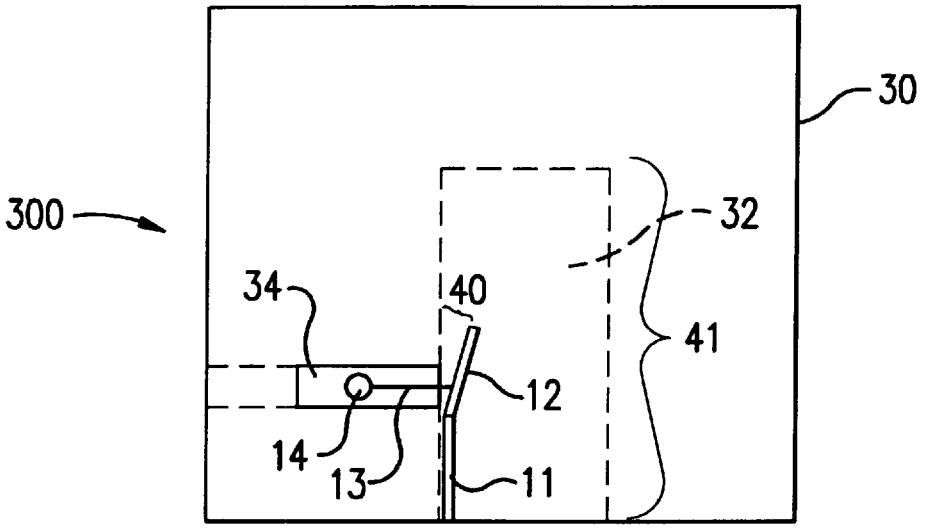
FIG. 4 is a side view of FIG. 3.

FIGS. 3 and 4 show the top and side views of the knob portion of the assembly of the present invention with the already described leaf spring element utilized therewithin. In FIG. 3 there is shown knob 300 invention including top surface 30 and side surface 31. It is understood that the outer shape of the knob itself may be any shape desired, and that the particular shape shown is in no way restrictive of the claimed invention. Within the knob shown in FIG. 3 is central hole 32 which is shaped in a semi-curricular pattern with flat section 33 to loosely accommodate a shaft with similar cross-sectional shape. Leaf spring element 10 as shown in FIG. 3 as positioned approximate to flat section 33 within central hole 32, with wire 13 and eyeloop 14 extending into channel 34. Channel 34 which has a width 36 laterally bisects the knob to one side of central hole 32. Optional hole 35 may be drilled through channel 34 and into central hole 32 so that there is a passage that communicates between channel 34 and central hole 32. When optional hole 35 is used, a plug is inserted after manufacture, as shown in FIG. 3, into the section before intersection with channel 34. If channel 34 is made such that it intersects with an edge of central hole 32, the channel and central hole would already then communicate thus not requiring optional hole 35. FIG. 4 shows a side view of the knob of FIG. 3 wherein is positioned leaf spring element 10 of FIG. 1. Bent portion 12 of leaf spring element 10 is shown in FIG. 4 as projecting inward a distance 40 into central hole 32. Eyeloop 14 is so configured so as to be located within channel 34. Central hole 32 is shown in FIG. 4 with a predetermined distance 41 into the knob.

Figure 5:
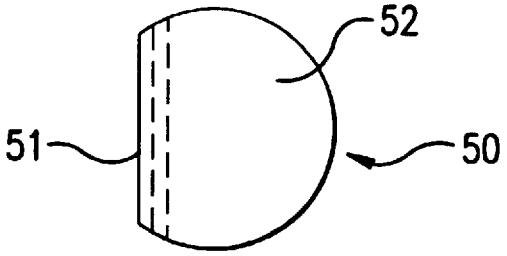
FIG. 5 is a top view of the shaft of the present invention.
Figure 6:
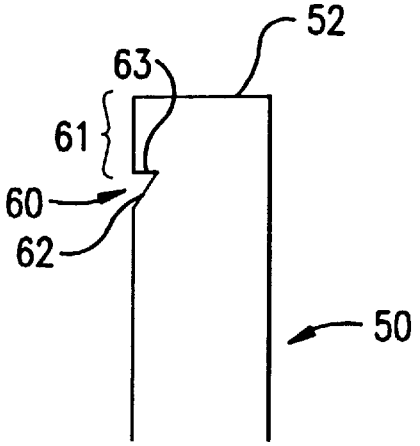
FIG. 6 is a side view of FIG. 5.

FIGS. 5 and 6 show the top and side views of the shaft portion of the assembly. Shaft 50 is circular shaped with flat portion 51 and top 52 so as to be loosely accommodated within central hole 32. Slanted notch 60 of FIG. 6 is shown on flat portion 51 of the shaft at a predetermined distance 61 from shaft top 52. The predetermined distance 61 is determined so that it is less than the distance 41 of FIG. 4, thus facilitating removal. Slanted notch 60 is comprised of slanted upward cut 62 and a slanted downward cut 63. The outward face of slanted downward cut 63 is sloped inward as illustrated in FIG. 6. The length of slanted notch 60 is determined by projecting inward distance 40 of leaf spring element 10.

In the preferred embodiment, a plastic knob of about one inch diameter is utilized, with a shaft of ¼ inches diameter. The shaft is made by fabricating a metal shaft as shown in any one of several ways: by pouring the metal into the shape shown, or machining the metal into the shape shown. The knob and its cavity could be made from plastic by injection molding. The channel and optional shaft are drilled into the knob by conventional means. The spring wire is glued or otherwise fastened to the flat edge of the central hole or can be positioned without fastening. The wire and eyeloop are soldered or brazed to the leaf spring.

Figure 7C:
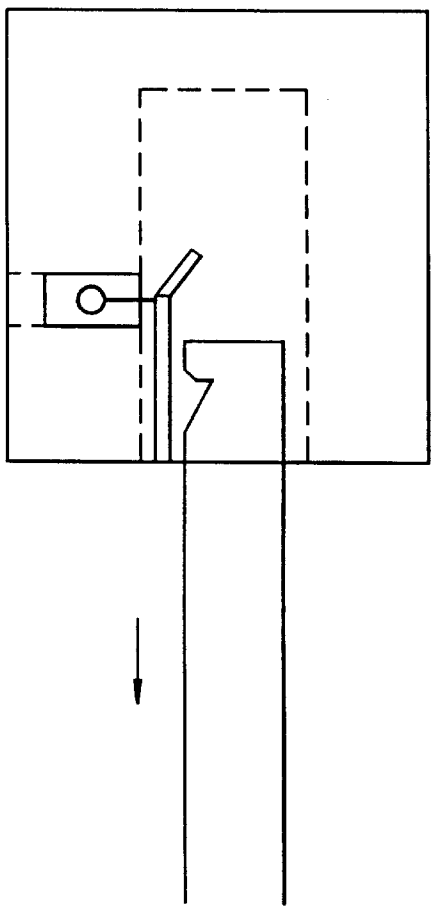
FIGS. 7*a*–7*c* are side views of engaged and disengaged positions for the leaf spring, knob, and shaft in cooperative relationship.
Figure 7B:
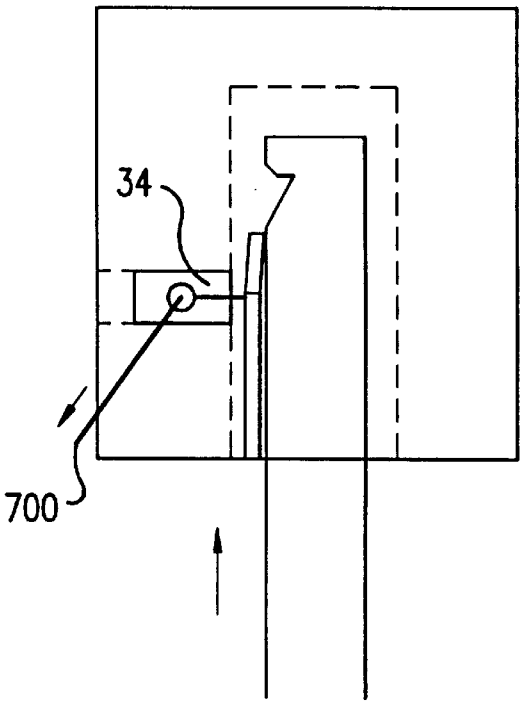
Figure 7A:
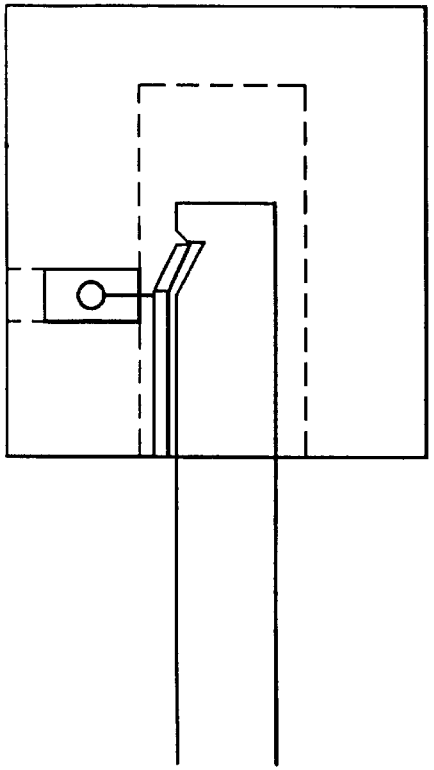

FIGS. 7*a*–7*c* show the cooperative relationship of the various elements of the invention. In operation, leaf spring element 10 is positioned within central hole 32 of knob 300. Knob 300 is then pressed onto shaft 50 until bent portion 12 of leaf spring element 10 snaps into slanted notch 60 locking knob 300 onto shaft 50 (as shown in FIG. 7*a*). To remove the knob, knob 300 is pressed down on shaft 50 until leaf spring element 10 is straightened. The straightened spring metal moves coupled wire 13 and eyeloop 14 so that eyeloop 14 coincides within channel 34. Leaf spring element 10 is then held in position by inserting a tool, such as stiff wire 700 into channel 34 which also goes through eyeloop 14 and thus stops bent portion 12 of leaf spring element 10 from bending back into slanted notch 60 (as shown in FIG. 7*b*). Knob 300 is then pulled off the shaft (as shown in FIG. 7*c*).

While this invention has been described in terms of preferred embodiment consisting of a releasable securing knob and shaft assembly, those skilled in the art will recognize that the invention can be practiced with modification within the spirit and scope of the appended claims.

Having thus described my invention, what I claim as new and desire to secure by Letters Patent is as follows:

1. A releasable securing knob assembly comprising:

a leaf spring element, with a straight and a bent portion, for releasably coupling a knob to a shaft, said leaf spring element further including a wire having an eyeloop at one end with the other end of said wire attached to said bent portion;

a shaft, with a semicircular shaped cross-section including a flat surface, said flat surface having an upwardly slanted notch for releasably engaging said bent portion;

a knob, including a knob side, said knob further including a recess within said knob shaped to accommodate said shaft and leaf spring element therewithin, said knob further including an access channel laterally bisecting therethrough to said knob side, and said access channel in physical communication with said recess, whereby when said leaf spring element is positioned within said recess, and said wire with said eyeloop is positioned within said access channel, and said knob is pressed onto said shaft and said leaf spring element, said leaf spring element inserts into and is biased against said upwardly slanted notch so that said knob is releasably secured to the shaft, and said knob is removed by debiasing the leaf spring element, so that said eyeloop coincides within said access channel, allowing said eyeloop to be held in position thus preventing said leaf spring element from biasing against said upwardly slanted notch.

* * * * *